US005945621A

United States Patent [19]

Ishibashi

[11] Patent Number: 5,945,621

[45] Date of Patent: Aug. 31, 1999

[54] MUSICAL TONE CONTROL APPARATUS WITH ENVELOPE PROCESSING

[75] Inventor: Susumu Ishibashi, Hamamatsu, Japan

[73] Assignee: Yamaha Corporation, Japan

[21] Appl. No.: 08/717,086

[22] Filed: Sep. 20, 1996

[30] Foreign Application Priority Data

Sep. 22, 1995 [JP] Japan ..... 7-268057

[51] Int. Cl.[6] ..... G10H 1/02; G10H 7/00

[52] U.S. Cl. ..... 84/627; 84/661; 84/663

[58] Field of Search ..... 84/616, 624, 626, 84/627, 654, 661–669, 738

[56] References Cited

U.S. PATENT DOCUMENTS

| | | | |
|---|---|---|---|
| 4,958,552 | 9/1990 | Minamitaka et al. | 84/616 X |
| 5,048,391 | 9/1991 | Uchiyama et al. | 84/738 X |
| 5,147,970 | 9/1992 | Obata | 84/616 X |
| 5,202,528 | 4/1993 | Iwaooji | 84/616 |
| 5,308,916 | 5/1994 | Murata et al. | 84/726 X |
| 5,710,387 | 1/1998 | Szalay . | |

FOREIGN PATENT DOCUMENTS

| | | |
|---|---|---|
| 6-12074 | 1/1994 | Japan . |
| WO95/16984 | 6/1995 | WIPO . |

*Primary Examiner*—Jeffrey W. Donels
*Attorney, Agent, or Firm*—Rossi & Associates

[57] ABSTRACT

In a musical tone control apparatus, musical tones to be generated are controlled according to musical tone control parameters which include an envelope that has been extracted and processed. The range of variation of the extracted envelope may be limited within a predetermined range, so that the musical tones are controlled according to the thus limited envelope. A key-on event of the input signal may be detected, and the timing of delivery of the processed envelope may be changed according to a length of time that elapses from a point of time when the key-on event is detected. The velocity of the input signal may also be detected, so that the musical tones are controlled according to the musical tone control parameters including one or more parameters altered according to the detected velocity and processed envelope.

12 Claims, 6 Drawing Sheets

MUSICAL TONE CONTROL APPARATUS WITH ENVELOPE PROCESSING

BACKGROUND OF THE INVENTION

1. Field of the Invention

The present invention relates to a musical tone control apparatus for controlling musical tones to be generated by controlling musical tone control parameters according to an input musical tone signal, in particular, a musical tone signal input through a guitar.

2. Prior Art

As an example of the musical tone control apparatus for controlling musical tones to be generated by controlling musical tone control parameters according to an input musical tone signal, there is known a guitar synthesizer adapted to detect a pitch of a musical tone generated when a player plays the guitar and to produce a musical tone according to the detected pitch. The guitar synthesizer as described above is able to produce a musical tone that is irrelevant to the tone color produced by playing the guitar. In many cases, the musical tone control parameters for controlling a musical tone to be generated are preliminarily determined, and the resulting musical tone is usually unlike that of the guitar. Thus, the conventional musical tone control apparatus, in particular, the guitar synthesizer, does not produce guitar-like sound even though the produced musical tone is controlled based on a musical tone generated by the guitar. It is desirable, however, that the guitar synthesizer produce sound that sounds more like that actually produced by a real guitar.

SUMMARY OF THE INVENTION

It is a first object of the invention to provide a musical tone control apparatus which is capable of producing guitar-like sound in a tone color different from that of a guitar.

It is a second object of the invention to provide a machine-readable storage medium for use in implementing the musical tone control apparatus of the preceding object.

To attain the first object, according to a first aspect of the invention, there is provided a musical tone control apparatus comprising musical tone control means for controlling musical tones to be generated, according to a plurality of musical tone control parameters, envelope extracting means for extracting an envelope of an input signal, envelope processing means for processing the envelope extracted by the envelope extracting means, and musical tone control parameter control means for delivering as one of the musical tone control parameters the envelope processed by the envelope processing means to the musical tone control means.

Preferably, in the first aspect of the invention, the envelope processing means is envelope limiting means for limiting a range of variation of the envelope extracted by the envelope extracting means, and the musical tone control parameter control means delivers as one of the musical tone control parameters the envelope which has the range variation thereof limited by the envelope limiting means, to the musical tone control means.

To attain the first object, according to a second aspect of the invention, there is provided a musical tone control means comprising, musical tone control means for controlling musical tones to be generated, according to a plurality of musical tone control parameters, envelope extracting means for extracting an envelope of an input signal, envelope processing means for processing the envelope extracted by the envelope extracting means, musical tone control parameter control means for delivering as one of the musical tone control parameters the envelope processed by the envelope processing means to the musical tone control means, key-on detecting means for detecting a key-on event of the input signal, and timing changing means for changing the timing of delivery of the envelope processed by the musical tone control parameter control means, according to a length of time that elapses from a point of time when the key-on event is detected by the key-on detecting means.

Preferably, in the second aspect of the invention, the timing changing means changes the timing of delivery of the processed envelope in a manner such that the processed envelope is delivered at intervals of a relatively shorter time period, for a portion thereof from a point of time when the key-on event is generated to a point of time when the processed envelope has a maximum value, and delivered at intervals of a relatively longer time period for subsequent portions thereof.

To attain the first object, according to a third aspect of the invention, there is provided a musical tone control apparatus comprising musical tone control means for controlling musical tones to be generated, according to a plurality of musical tone control parameters, envelope extracting means for extracting an envelope of an input signal, envelope processing means for processing the envelope extracted by the envelope extracting means, musical tone parameter altering means for altering at least one predetermined parameter of the musical tone control parameters according to the envelope processed by the envelope processing means, and musical tone control parameter control means for delivering as part of the musical tone control parameters the envelope processed by the envelope processing means and the at least one predetermined parameter altered by the musical tone control parameter altering means to the musical tone control means.

Preferably, the musical tone control apparatus according to the third aspect of the invention includes filter means for filtering a frequency of the musical tones to be generated, and wherein the musical tone control parameter altering means controls a cutoff frequency of the filter means according to the envelope processed by the envelope processing means.

Alternatively of or together with the controlling of the cutoff frequency of the filter means, the musical tone control parameter altering means controls at least one of a pitch, amplitude, modulated wave and amplitude of modulated wave of the musical tones to be generated, according to the envelope processed by the envelope processing means.

To attain the first object, according to a fourth aspect of the invention, there is provided a musical tone control apparatus comprising musical tone control means for controlling musical tones to be generated, according to a plurality of musical tone control parameters, envelope extracting means for extracting an envelope of an input signal, envelope processing means for processing the envelope extracted by the envelope extracting means, velocity detecting means for detecting a velocity of the input signal, musical tone control parameter altering means for altering at least one predetermined parameter of the musical tone control parameters according to the envelope processed by the envelope processing means and the velocity detected by the velocity detecting means, and musical tone control parameter control means for delivering as part of the musical tone control parameters the envelope processed by the envelope processing means and the at least one predetermined parameter altered by the musical tone control parameter altering means to the musical tone control means.

Preferably, the musical tone control apparatus according to the fourth aspect of the invention includes filter means for filtering a frequency of the musical tones to be generated, and wherein the musical tone control parameter altering means controls a cutoff frequency of the filter means according to the envelope processed by the envelope processing means and the velocity detected by the velocity detecting means, and alternative of or together with the controlling of the cutoff frequency, the musical tone control parameter altering means controls at least one of a pitch, amplitude, modulated wave and amplitude of modulated wave of the musical tones to be generated, according to the envelope processed by the envelope processing means and the velocity detected by the velocity detecting means.

To attain the second object, according to a fifth aspect of the invention, there is provided a machine-readable storage medium containing instructions to cause a machine to perform a method of controlling musical tones to be generated, the method comprising a musical tone control step of controlling musical tones to be generated, according to a plurality of musical tone control parameters, an envelope extracting step of extracting an envelope of an input signal, an envelope processing step of processing the envelope extracted by the envelope extracting step, and a musical tone control parameter control step of delivering as one of the musical tone control parameters the envelope processed by the envelope processing step to the musical tone control step.

In a preferred embodiment of the fifth aspect, the envelope processing step is an envelope limiting step of limiting a range of variation of the envelope extracted by the envelope extracting step, and the musical tone control parameter control step delivers as one of the musical tone control parameters the envelope which has the range variation thereof limited by the envelope limiting step, to the musical tone control step.

To attain the second object, according to a sixth aspect of the invention, there is provided a machine-readable storage medium containing instructions to cause a machine to perform a method of controlling musical tones to be generated, the method comprising a musical tone control step of controlling musical tones to be generated, according to a plurality of musical tone control parameters, an envelope extracting step of extracting an envelope of an input signal, an envelope processing step of processing the envelope extracted by the envelope extracting step, a musical tone control parameter control step of delivering as one of the musical tone control parameters the envelope processed by the envelope processing step to the musical tone control step, a key-on detecting step of detecting a key-on event of the input signal, and a timing changing step of changing the timing of delivery of the envelope processed by the musical tone control parameter control step, according to a length of time that elapses from a point of time when the key-on event is detected by the key-on detecting step.

To attain the second object, according to a seventh aspect of the invention, there is provided a machine-readable storage medium containing instructions to cause a machine to perform a method of controlling musical tones to be generated, the method comprising a musical tone control step of controlling musical tones to be generated, according to a plurality of musical tone control parameters, an envelope extracting step of extracting an envelope of an input signal, an envelope processing step of processing the envelope extracted by the envelope extracting step, a musical tone parameter altering step of altering at least one predetermined parameter of the musical tone control parameters according to the envelope processed by the envelope processing step, and a musical tone control parameter control step of delivering as part of the musical tone control parameters the envelope processed by the envelope processing step and the at least one predetermined parameter altered by the musical tone control parameter altering step to the musical tone control step.

To attain the second object, according to an eighth aspect of the invention, there is provided a machine-readable storage medium containing instructions to cause a machine to perform a method of controlling musical tones to be generated, the method comprising a musical tone control step of controlling musical tones to be generated, according to a plurality of musical tone control parameters, an envelope extracting step of extracting an envelope of an input signal, an envelope processing step of processing the envelope extracted by the envelope extracting step, a velocity detecting step of detecting a velocity of the input signal, a musical tone control parameter altering step of altering at least one predetermined parameter of the musical tone control parameters according to the envelope processed by the envelope processing step and the velocity detected by the velocity detecting step, and a musical tone control parameter control step of delivering as part of the musical tone control parameters the envelope processed by the envelope processing step and the at least one predetermined parameter altered by the musical tone control parameter altering step to the musical tone control step.

The above and other objects, features and advantages of the invention will be more apparent from the following detailed description taken in conjunction with the accompanying drawings.

DETAILED DESCRIPTION OF THE PREFERRED EMBODIMENT

There will be described in detail one preferred embodiment of the invention referring to the accompanying drawings.

Figure 1:
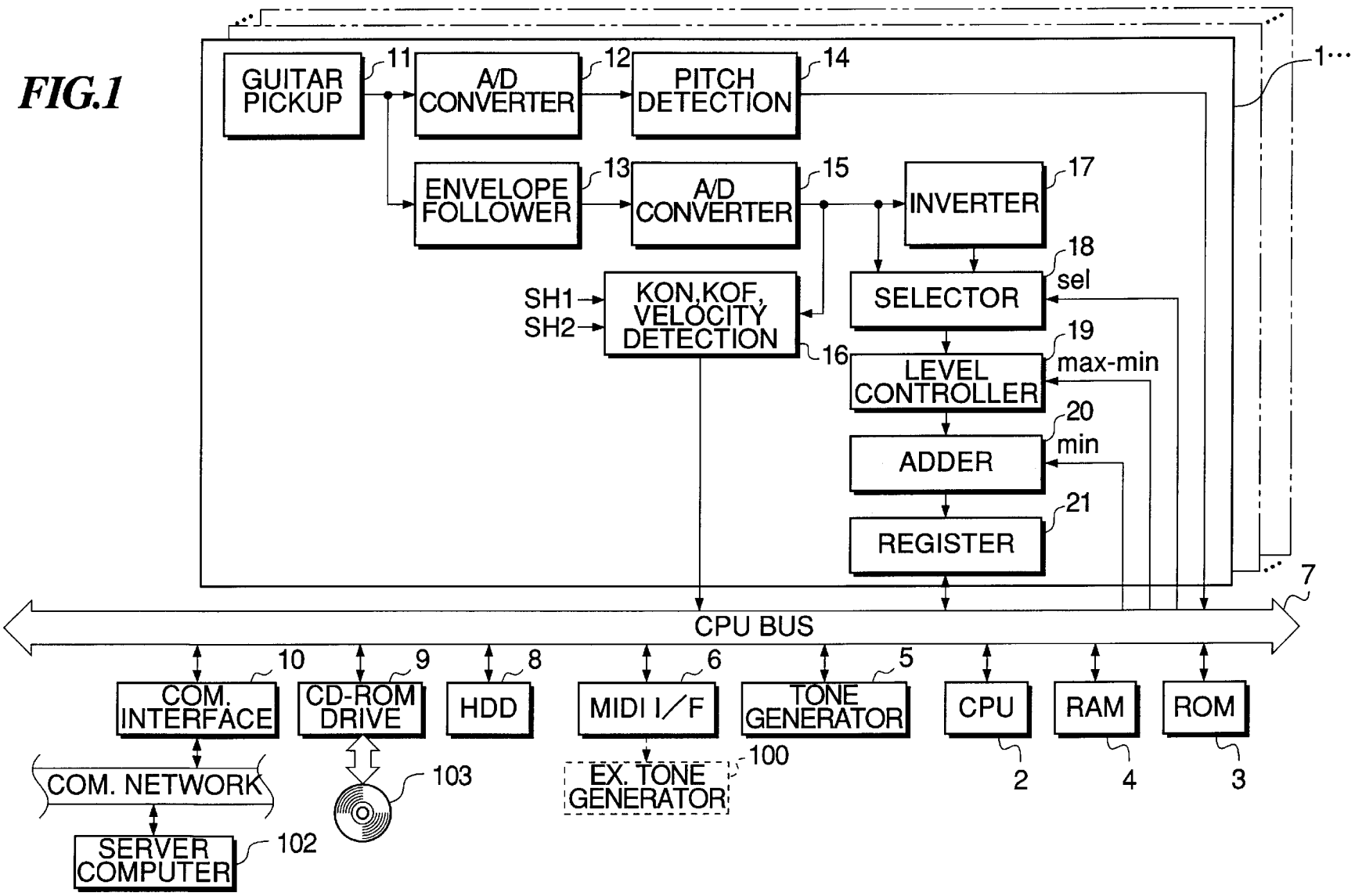
FIG. 1 is a block diagram schematically showing a guitar synthesizer as one embodiment of the musical tone control apparatus according to the present invention.

Referring first to FIG. 1, there is schematically shown the construction of a guitar synthesizer as one embodiment of the musical tone control apparatus of the invention. As shown in FIG. 1, the guitar synthesizer of the present embodiment includes a plurality of input signal-processing units 1 for detecting vibration signals input through respective strings (e.g., six strings) of a guitar (not shown), and performing signal processing on the detected signals. The present guitar synthesizer further includes: a CPU 2 for controlling the whole apparatus; a ROM 3 storing control programs executed by the CPU 2, table data and the like; a RAM 4 for temporarily storing various input information, computing results and the like; a tone generator 5 for producing musical tone signals according to the signals processed by the input signal-processing units 1, for example, and converting the produced signals into sound; and a MIDI interface (I/F) 6 to which is connected an external tone generator 100 capable of recognizing MIDI (Musical Instrument Digital Interface) signals, and which serves to output the MIDI signals to the external tone generator 100 so as to generate musical tones. These components 1 through 6 are connected to each other through a CPU bus 7.

Further connected to the CPU bus 7 are a hard disk drive (HDD) 8, a CD-ROM drive 9, and a communication interface (COM. I/F) 10.

The HDD 8 stores various application programs including control programs and various data. The CD-ROM drive 9 drives a CD-ROM 103 which stores various application programs including control programs and various data. The MIDI I/F 6 receives MIDI signals from an external device such as the MIDI device 100 and delivers MIDI signals to the external device. The generator 5, in addition to the above-mentioned function, converts musical data (automatic performance data) and like data received from the CD-ROM drive 9 or the MIDI I/F 6 into musical tone signals.

The HDD 8 can store control programs executed by the CPU 5 as mentioned above. In the case where no control program is stored in the ROM 3, a control program may be stored in a hard disk within the HDD 8, and this control program may be read into the RAM 4 so that the CPU 2 operates on the control program in the same way as if a control program is stored in the ROM 3. By so doing, the addition of a control program and version-up of the control program are facilitated.

A control program or data read from the CD-ROM 103 by the CD-ROM drive 9 is stored in the hard disk within the HDD 8. It is thus easy to install a further control program or a new version of the control program. Devices for utilizing various types of media including a floppy disk drive and a magneto-optical (MO) disk drive may also be provided as external storage devices.

The communication I/F 10 is connected to a communication network 101 such as a LAN (local area network), an internet or a telephone line, through which it is connected to a server computer 102 to deliver and receive data to and from the latter. In the case where any control program or various data is not stored in the HDD 8, the communication I/F 10 is used to download programs and data from the server computer 102. The present guitar synthesizer constituting a client transmits a command requesting the server computer 102 to download a control program and data through the communication interface 10 and the communication network 101. The server computer 102 receives this command and delivers the requested control program and data to the guitar synthesizer through the communication network 101. The guitar synthesizer receives the program and data through the communication interface 10 and accumulates them in the HDD 8. The downloading is thus completed.

The present invention may alternatively be implemented by the use of a commercially available personal computer or the like with a control program and data adapted to the invention installed therein. In such a case, a storage medium such as a CD-ROM or a floppy disk which stores the control program and data adapted to the invention and can be read by a personal computer can be offered to the user. In the case where such a personal computer or the like is connected to a communication network like a LAN, an internet or a telephone line, the control program and the data can be offered to the personal computer or the like through the communication network.

The input signal-processing units 1 are adapted to detect vibrations of respective strings independently of each other, convert the string vibrations into electric signals, and perform various signal processing. The guitar synthesizer of the present embodiment, which is supposed to be a six-stringed guitar, has six input signal-processing units 1 each consisting of the same components. In the following description, only one input signal-processing unit will be explained in the interest of brevity and convenience.

In the input signal-processing unit 1, an analog musical tone signal (vibration signal) detected by a guitar pickup 11 is divided into two signals, one of which is fed to an A/D converter 12 for converting this analog musical tone signal into a digital musical tone signal, and the other of which is fed to an envelope follower 13 for detecting the envelope of the analog musical tone signal.

A pitch of the musical tone signal converted by the A/D converter 12 into the digital signal is detected by a pitch detecting block 14, and the detected pitch is supplied to the CPU bus 7. The envelope of the analog musical tone signal detected by the envelope follower 13 is supplied to an A/D converter 15 where it is converted into a digital signal, which is then divided into three signals, of which a first signal is fed to a key-on (KON), key-off (KOFF), velocity-detecting block 16, a second signal is fed to an inverter 17 for inverting the shape of the envelope, and a third signal is fed to a selector 18 for selecting one of an inverted output signal from the inverter 17 and an output signal from the A/D converter 15.

Figure 2A:
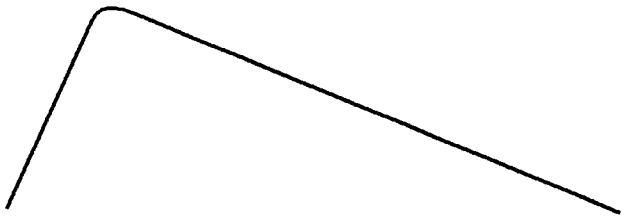
FIGS. 2A to 2C are views showing one example of the shape of an envelope that is detected and processed by a guitar pickup of FIG. 1.
Figure 2B:
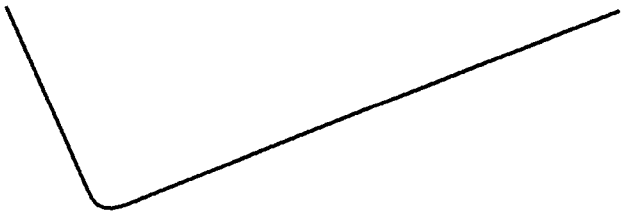
Figure 2C:
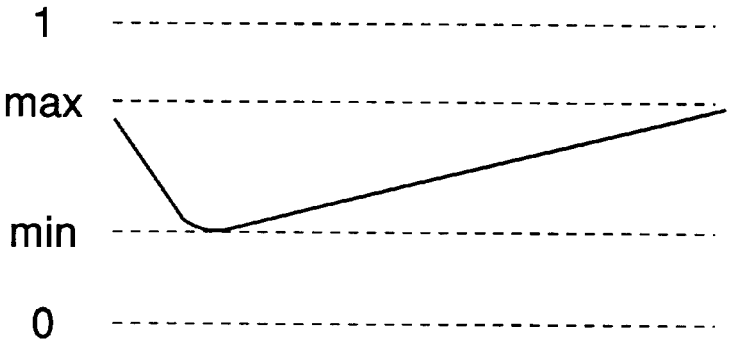

FIGS. 2A through 2C show one example of the shape of the envelope that is detected and processed by the guitar pickup 11, wherein FIG. 2A indicates the shape of the envelope generated by the A/D converter 15, FIG. 2B indicates the shape of the envelope generated by the inverter 17, and FIG. 2C indicates the shape of the envelope read from a register 21 which will be described later.

To the key-on/key-off detecting block 16 are supplied signals SH1 and SH2 from the ROM 3 by the CPU 2, the signal SH1 representing a first threshold value used for detecting a key-on event, and the signal SH2 representing a second threshold value used for detecting a key-off event. The key-on/key-off-detecting block 16 compares the envelope signal received from the A/D converter 15 with the signals SH1 and SH2, to thereby generate and deliver output signals representing respective points of time of key-on and key-off events to the CPU bus 7. At the same time, the key-on/key-off-detecting block 16 detects the maximum value of the envelope, for example, as a velocity value, and outputs the detected value to the CPU bus 7.

The selector 18, to which a select signal "sel" is supplied from the CPU 2 through the CPU bus 7, delivers to a level controller 19 a selected one of the output from the A/D converter 15 as it is and the output from the inverter 17 where the output from the A/D converter 15 has been inverted, depending upon the level of the select signal "sel".

To the level controller 19 is supplied a signal "max−min" representing a difference between the maximum level (max)

and the minimum level (min). This level controller 19 performs level control for controlling the level of the output signal from the selector 18 to within a range of the signal "max−min", and outputs the controlled signal to an adder 20. More specifically, the level controller 19 performs an arithmetic operation in which the level of the signal "max−min" is multiplied by the level of the envelope (the output signal from the selector 18).

The adder 20, to which an offset signal "min" representing the above minimum level (min) is supplied, offsets the signal controlled by the level controller 19 only by the level of the signal "min", and outputs the offset result ((max−min)× envelope value+min) to the register 21. If the register 21 has a large capacity, level values of the envelope as shown in FIG. 2A, for example, may be accumulated in the register 21. However, the register 21 having a capacity large enough to store only one set of data suffices, since data stored in the register 21 are immediately read by the CPU 2 in the actual operation.

The offset result (or processed envelope) stored in the register 21 is read out by the CPU 2 in a desired timing, and used for control as described later.

While a method of processing the envelope that has been inverted and using the result of the processing for after-touch control will be mainly described in the present embodiment, it is to be understood that the envelope that is not inverted may be processed and used for the after-touch control.

Figure 3:
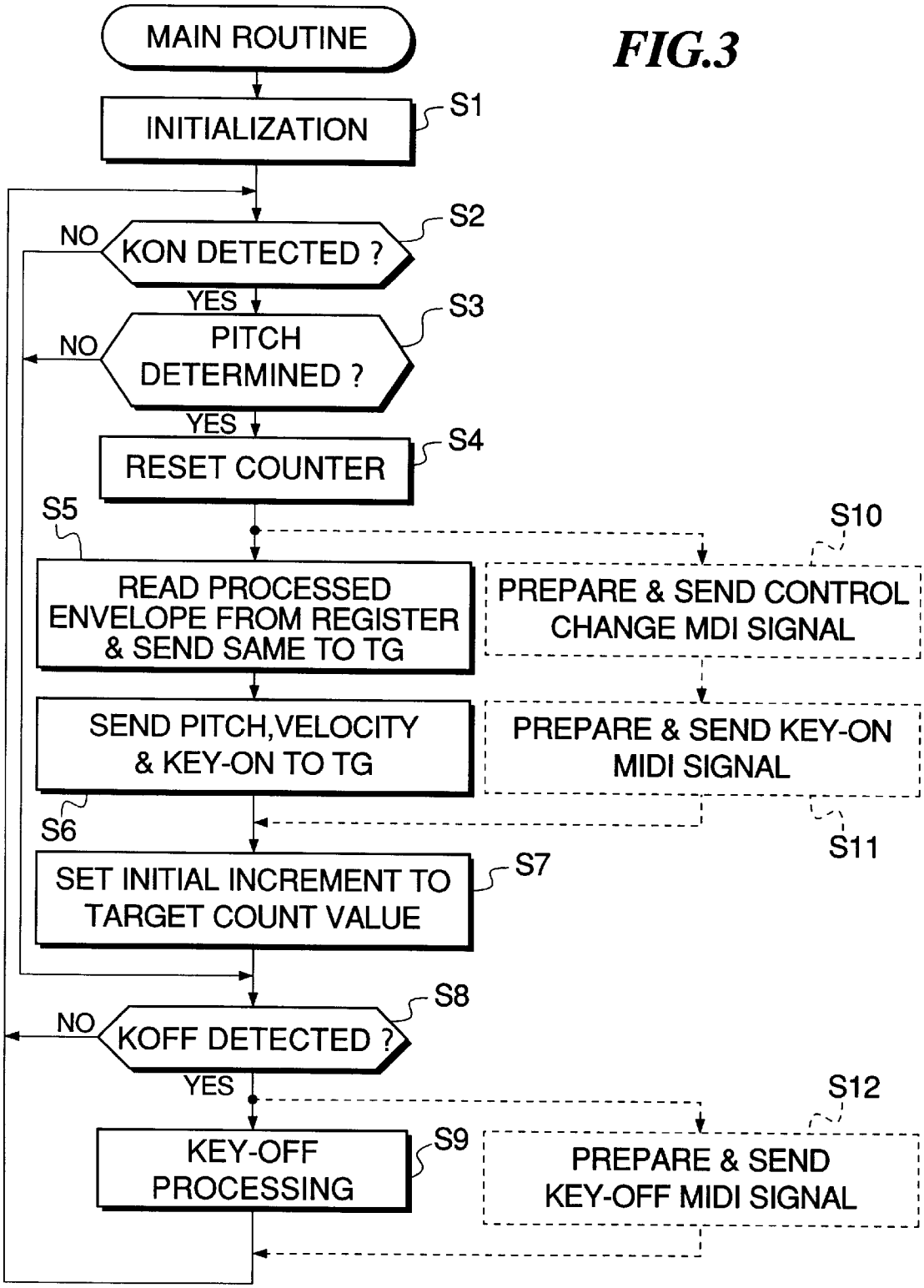
FIG. 3 is a flowchart showing a main routine executed by CPU of FIG. 1.
Figure 4:
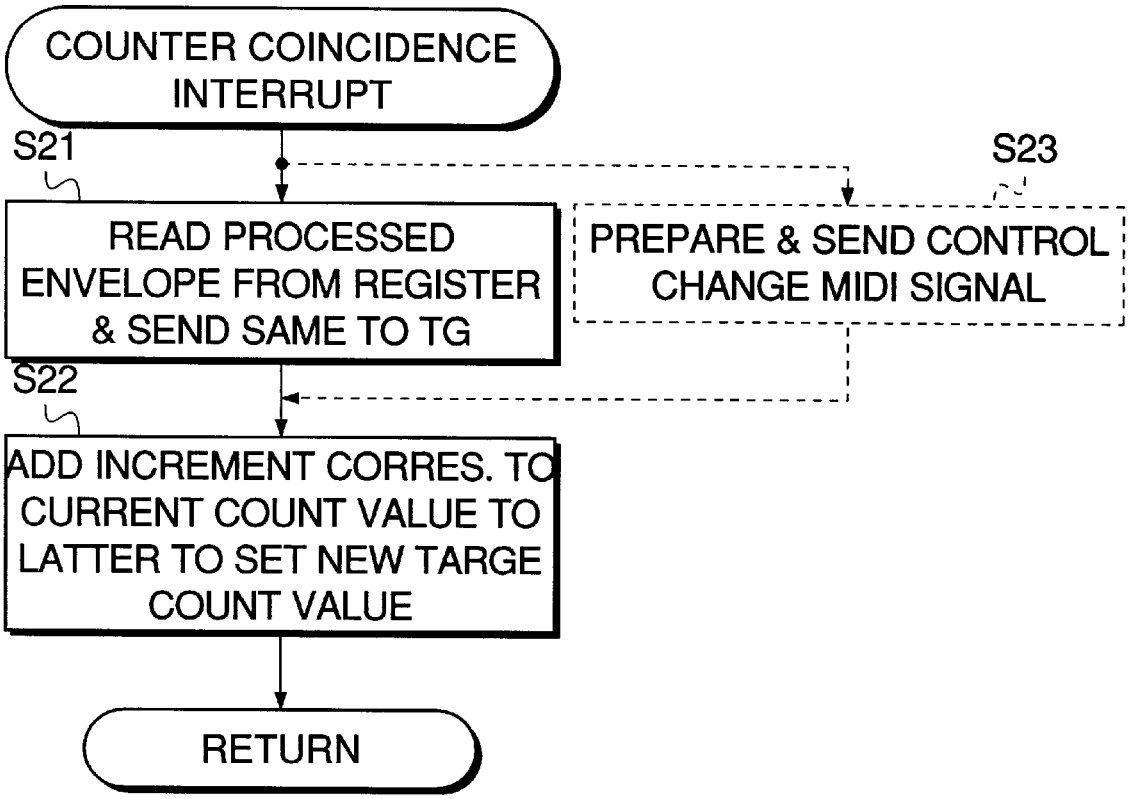
FIG. 4 is a flowchart showing a counter coincidence interrupt handling.
Figure 5:
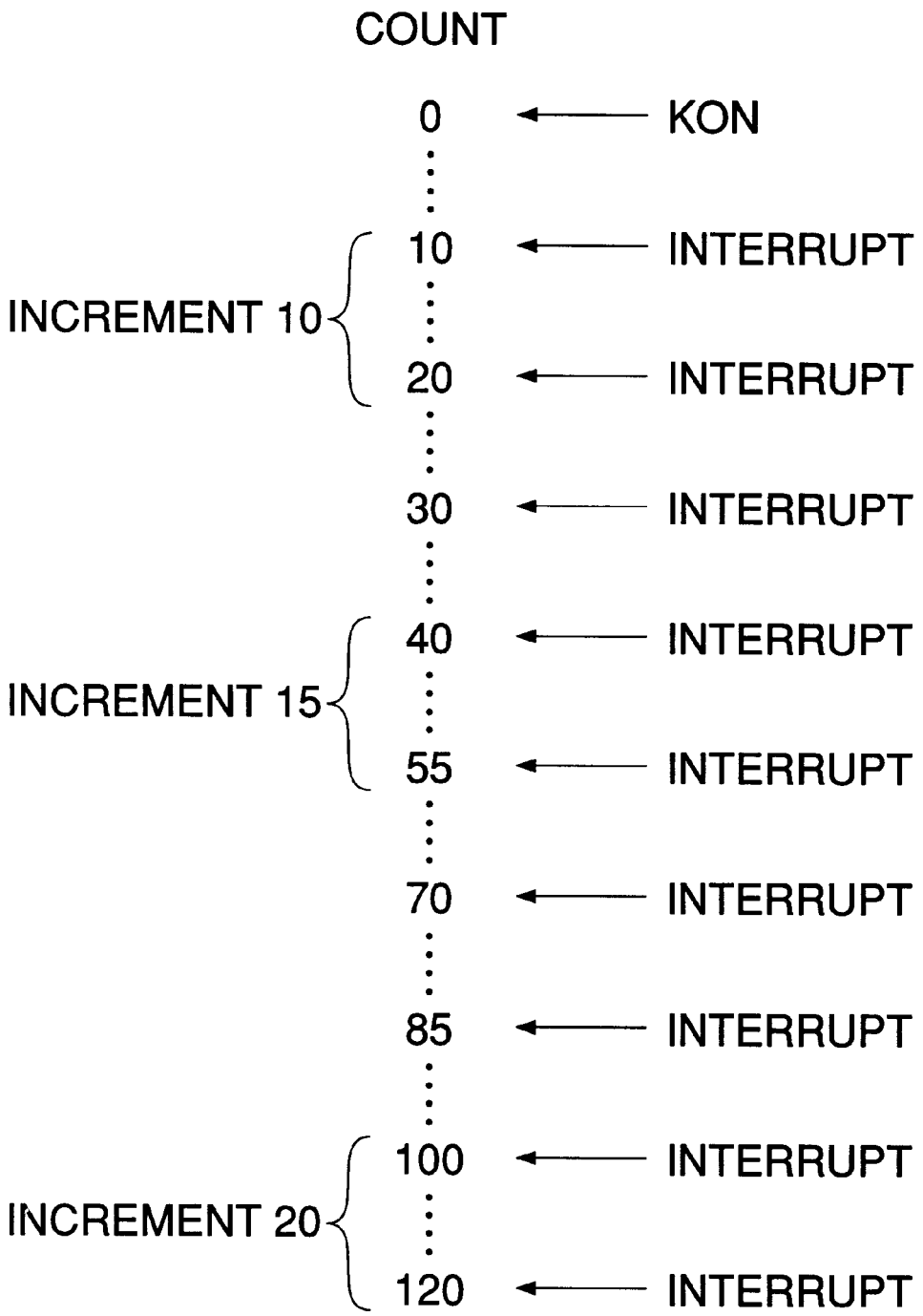
FIG. 5 is a view showing one example of the transition of a target count value CNT and the timing of occurrence of counter coincidence interruption.

Referring to FIGS. 3 through 5, there will be explained a control operation implemented by the guitar synthesizer constructed as described above.

FIG. 3 shows a main routine executed by the CPU 2 of the guitar synthesizer of the present embodiment. While steps S2–S9 of this routine need to be executed with respect to each of the input signal-processing units 1, only the processing with respect to one input signal-processing unit is shown in FIG. 3 for convenience sake.

At a step S1 of FIG. 3, the guitar synthesizer is initialized by clearing RAM 4, various ports and others, for example. At the next step S2, it is determined whether or not a key-on event (KON) has been detected or not. This determination may be made by checking if the above-indicated key-on/key-off-detecting block 16 has detected a key-on event. If it is determined at the step S2 that a key-on event has been detected, it is then determined at a step S3 whether or not a pitch has been determined. This determination may be made by checking the output from the pitch detecting block 14.

If it is determined at the step S3 that the pitch has been determined, a step S4 is executed to reset a counter which is incorporated in the CPU 2 or the like and serves to generate counter coincidence interruption. In this regard, the present embodiment includes six counters like the above one for the same number of the input signal-processing units, and one of these counters that corresponds to the currently operating input signal-processing unit is reset. The counter may be incremented during a timer interrupt handling (not shown) executed in synchronization with a predetermined interruption cycle.

At the subsequent step S5, the processed envelope value is read from the register 21, and fed to the tone generator 5. Then, at a step S6, the pitch detected by the pitch detecting block 14, and the velocity and key-on signal detected by the key-on/key-off-detecting block 16 are transmitted to the tone generator 5. The tone generator 5 generates a musical tone signal according to the data thus transmitted, and converts the signal into sound.

At the next step S7, an initial increment amount is stored as a target count value in a predetermined region CNT of the RAM 4 (the content of which will be hereinafter referred to as "target count value CNT"). Then, at a step S8, it is determined whether a key-off event has been detected.

If no key-off event has been detected at the step S8, the processing of the step S2 and subsequent steps are repeated with respect to the next input signal-processing unit. If a key-off event has been detected at the step S8, key-off processing, such as outputting of a key-off signal to the tone generator 5, is effected, and then the processing of the step S2 and subsequent steps are repeated with respect to the next input signal-processing unit.

If no key-on event has been detected at the step S2 or if the pitch has not been determined at the step S3, on the other hand, the control flow jumps to the step S8.

In the case where musical tones are not generated from the tone generator 5, but from the external tone generator 100 connected to the CPU bus 7 through the MIDI I/F 6, the above steps S5, S6 may be replaced by steps S10, S11, respectively, and the above step S9 may be replaced by a step S12. More specifically, at the step S10, the processed envelope value is read from the register 21, and a MIDI signal indicative of a control change message is prepared according to the read value and fed to the MIDI I/F 6, so that the external tone generator 100 generates a musical tone. At the step S11, a MIDI signal indicative of the key-on event is prepared according to the detected pitch and velocity, and the prepared signal is fed to the MIDI I/F 6, in the same manner as in the step S6. To terminate the generation of a musical tone, on the other hand, a MIDI signal indicative of the key-off event is prepared and fed to the MIDI I/F 6 at the step S12.

FIG. 4 shows details of the counter coincidence interrupt handling. This interrupt handling is executed when the value of the above-indicated counter coincides with the target counter value CNT.

At a step S21 of FIG. 4, the processed envelope value is read from the register 21 and fed to the tone generator 5, in the same manner as in the step S5. Then, at a step S22, an increment amount corresponding to the current value of the counter is added to the current counter value, to provide a new target counter value CNT, followed by the present interrupt handling being terminated. In the case where musical tones are not generated from the tone generator 5, but from the external tone generator 100 connected to the CPU bus 7 through the MIDI I/F 6, the above step S21 may be replaced by a step S23, which is similar to the above-described step S10 and thus will not be explained.

FIG. 5 shows one example of the transition of the target count value CNT, and the timing of occurrence of the counter coincidence interruption. As shown in FIG. 5, if a key-on event is detected, the target count value CNT is set to "10 (initial increment amount)", and the counter coincidence interruption occurs at the point of time when the counter counts "10". An increment amount "10" with respect to the current count value is then added to the current count value "10", so that the target count value CNT is set to "20". When the counter counts "20", the counter coincidence interruption occurs, and similar processing are repeated. The increment amount is then changed from "10" to "15" when the counter counts "40", and the increment amount is changed to "20" when the counter counts "100". Thus, the time interval at which the counter coincidence interruption occurs is increased with the lapse of time, thereby reducing the load on the CPU 2. It is to be understood that numeral values in FIG. 5 are merely illustrative.

In the present embodiment as described above, musical tones are produced on the basis of the processed envelope obtained by processing the envelope of string vibration, thus enabling the guitar synthesizer to generate guitar-like musical tones in a tone color different from that of a guitar. Further, more subtle control of musical tones can be performed so as to express the nuance of guitar sound since the polarity of the extracted envelope is changed by the selector 17, and the selected envelope is confined by the level controller 19 within its upper and lower limits. Moreover, the increment amount of the target count value CNT is increased with the lapse of time, so as to be set to a small value for an attack portion of the input signal (i.e. corresponding to a time from immediately after note-on to the maximum level of the envelope) that needs to be well expressed, and to large values for subsequent portions. When the signal processing is performed for a plurality of channels (six channels), therefore, the load on the CPU 2 can be reduced, and the processing of the external tone generator 100 for receiving signals can be also simplified.

Figure 6A:
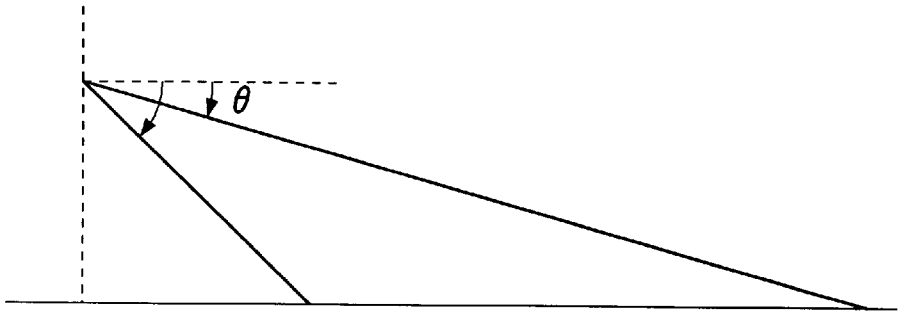
FIG. 6A is a graph for explaining a method of changing an interrupt cycle of the counter coincidence interruption.

In the illustrated embodiment, the increment amount of the target count value CNT is changed with the lapse of time, and the envelope value is fed to the tone generator 5 at the point of time when the target count value CNT coincides with the count value of the counter. However, the present invention is not limited to this embodiment. As shown in FIG. 6A, a pseudo envelope may be prepared by changing the angle θ according to the velocity, and values of the thus prepared pseudo envelope read at intervals of a predetermined time period are compared with a predetermined target value. At the point of time when the value of the pseudo envelope coincides with the predetermined target value, this envelope value is fed to the tone generator 5. Since the interrupt cycle is thus changed according to the velocity, the after-touch control can be effected only when it is necessary. In place of using the pseudo envelope, an envelope detected by the guitar pickup 11 may be changed according to the velocity.

Figure 6B:
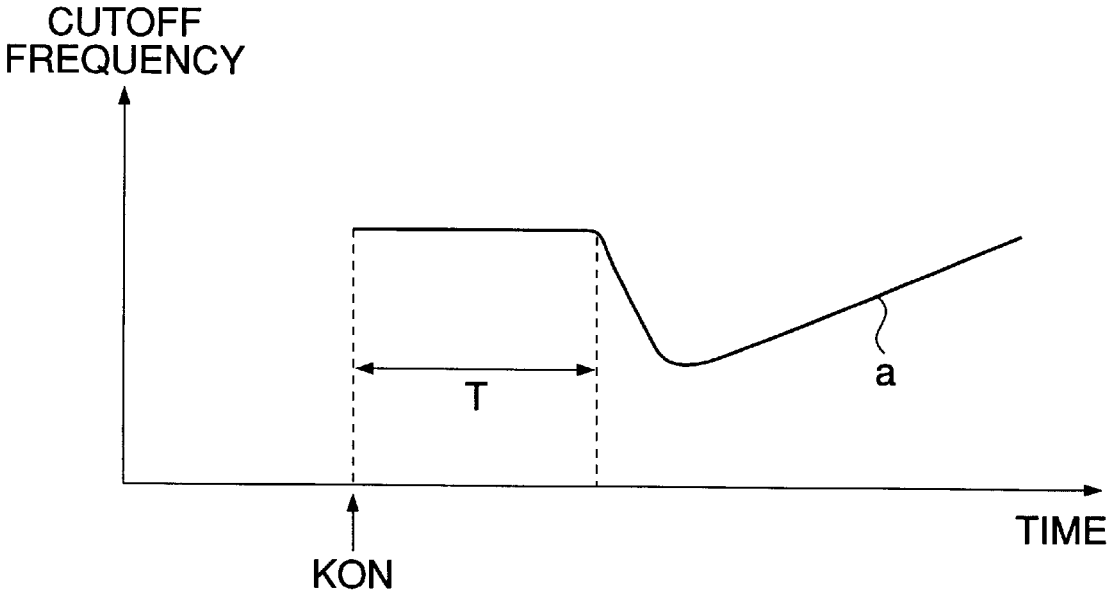
FIG. 6B is a graph showing one example in which another parameter is controlled by the musical tone control apparatus of the illustrated embodiment.

While the envelope that is detected and processed is transmitted as envelope data to the tone generator 5 in the illustrated embodiment, the detected and processed envelope may be used for control of other parameters, such as the cutoff frequency of a filter of the tone generator 5 that is changed with time. FIG. 6B shows one example of control wherein the cutoff frequency is changed with time. In this graph, the axis of ordinates indicates the cutoff frequency, and the axis of abscissas indicates time. Once a key-on event is detected, the cutoff frequency is determined depending upon the velocity, and the filter operates to filter the musical tone signal at the determined cutoff frequency for a predetermined time period T, and thereafter filter the signal at the cutoff frequency that varies along the curve "a" as shown in FIG. 6B. Thus, the musical tone is controlled by the velocity and envelope. The curve "a" of FIG. 6B is prepared by using the envelope of FIG. 2C. Other parameters that can be controlled by the processed envelope include the pitch, amplitude, frequency and amplitude of modulated wave, and any other parameter that can be controlled. In this connection, the velocity corresponds to the intensity of pluck of the string, and the detected envelope represents changes in the velocity that correspond to its vibrations. Both the velocity and the envelope are used to control the filter or other musical tone element, so as to obtain richer, more guitar-like tone variation.

While the envelope value of string vibration is successively read, processed and transmitted to the tone generator 5 in the illustrated embodiment, the object to be controlled is not limited to an after-touch controller, but may be selected from various other controllers.

While the illustrated embodiment is constructed such that data for producing musical tones are transmitted to a selected one of the tone generator 5 and the MIDI I/F 6, the data may be transmitted to both of the tone generator 5 and the MIDI I/F 6.

What is claimed is:

1. A musical tone control apparatus comprising:

musical tone control means for controlling musical tones to be generated, according to a plurality of musical tone control parameters;

envelope extracting means for extracting an envelope of an input signal;

envelope limiting means for limiting a range of variation of the envelope extracted by said envelope extracting means; and musical tone control parameter control means for delivering as one of said musical tone control parameters the envelope which has the range variation thereof limited by said envelope limiting means, to said musical tone control means.

2. A musical tone control means comprising:

musical tone control means for controlling musical tones to be generated, according to a plurality of musical tone control parameters;

envelope extracting means for extracting an envelope of an input signal;

envelope processing means for processing the envelope extracted by said envelope extracting means;

musical tone control parameter control means for delivering as one of said musical tone control parameters the envelope processed by said envelope processing means to said musical tone control means;

key-on detecting means for detecting a key-on event of said input signal; and timing changing means for changing the timing of delivery of the envelope processed by said musical tone control parameter control means, according to a length of time that elapses from a point of time when the key-on event is detected by said key-on detecting means.

3. A musical tone control apparatus as claimed in claim 2, wherein said timing changing means changes the timing of delivery of the processed envelope in a manner such that the processed envelope is delivered at intervals of a relatively shorter time period, for a portion thereof from a point of time when said key-on event is generated to a point of time when the processed envelope has a maximum value, and delivered at intervals of a relatively longer time period for subsequent portions thereof.

4. A musical tone control apparatus as comprising:

musical tone control means for controlling musical tones to be generated, according to a plurality of musical tone control parameters;

envelope extracting means for extracting a envelope of an input signal;

envelope processing for processing the envelope extracted by said envelope extracting means;

musical tone parameter altering at least one predetermined parameter of said musical tone control parameters according to the envelope processed by said envelope processing means;

musical tone control parameter control means for delivering as part of said musical tone control parameters the envelope processed by said envelope processing means said and the at least one predetermined parameter altered by said musical tone control parameter altering means to said musical tone control means; and filter means for filtering a frequency of the musical tones to be generated;

wherein said musical tone control parameter altering means controls a cutoff frequency of said filter means according to the envelope processed by said envelope processing means.

5. A musical tone control apparatus as comprising:

musical tone control means for controlling musical tones to be generated, according to a plurality of musical tone control parameters;

envelope extracting means for extracting a envelope of an input signal;

envelope processing means for processing the envelope extracted by said envelope extracting means;

musical tone parameter altering means for altering at least one predetermined parameter of said musical tone control parameters according to the envelope processed by said envelope processing means; and musical tone control parameter control means for delivering as part of said musical tone control parameters the envelope processed by said envelope processing means and the at least one predetermined parameter altered by said musical tone control parameter altering means to said musical tone control means;

wherein said musical tone control parameter altering means controls at least one of a pitch, amplitude, modulated wave and amplitude of modulated wave of said musical tones to be generated, according to the envelope processed by said envelope processing means.

6. A musical tone control apparatus comprising:

musical tone control means for controlling musical tones to be generated, according to a plurality of musical tone control parameters;

envelope extracting means for extracting an envelope of an input signal;

envelope processing means for processing the envelope extracted by said envelope extracting means;

velocity detecting means for detecting a velocity of said input signal;

musical tone control parameter altering means for altering at least one predetermined parameter of said musical tone control parameters according to the envelope processed by said envelope processing means and the velocity detected by said velocity detecting means; and musical tone control parameter control means for delivering as part of said musical tone control parameters the envelope processed by said envelope processing means and the at least one predetermined parameter altered by said musical tone control parameter altering means to said musical tone control means.

7. A musical tone control apparatus as claimed in claim 6, including filter means for filtering a frequency of the musical tones to be generated, and wherein said musical tone control parameter altering means controls a cutoff frequency of said filter means according to the envelope processed by said envelope processing means and the velocity detected by said velocity detecting means.

8. A musical tone control apparatus as claimed in claim 6, wherein said musical tone control parameter altering means controls at least one of a pitch, amplitude, modulated wave and amplitude of modulated wave of said musical tones to be generated, according to the envelope processed by said envelope processing means and the velocity detected by said velocity detecting means.

9. A machine-readable storage medium containing instructions to cause a machine to perform a method of controlling musical tones to be generated, said method comprising:

a musical tone control step of controlling musical tones to be generated, according to a plurality of musical tone control parameters;

an envelope extracting step of extracting an envelope of an input signal;

an envelope limiting step of limiting a range of variation of the envelope extracted by said envelope extracting step; and a musical tone control parameter control step of delivering as one of said musical tone control parameters the envelope which has the range variation thereof limited by said envelope limiting step, to said musical tone control step.

10. A machine-readable storage medium containing instructions to cause a machine to perform a method of controlling musical tones to be generated, said method comprising:

a musical tone control step of controlling musical tones to be generated, according to a plurality of musical tone control parameters;

an envelope extracting step of extracting an envelope of an input signal;

an envelope processing step of processing the envelope extracted by said envelope extracting step;

a musical tone control parameter control step of delivering as one of said musical tone control parameters the envelope processed by said envelope processing step to said musical tone control step;

a key-on detecting step of detecting a key-on event of said input signal; and a timing changing step of changing the timing of delivery of the envelope processed by said musical tone control parameter control step, according to a length of time that elapses from a point of time when the key-on event is detected by said key-on detecting step.

11. A machine-readable storage medium containing instructions to cause a machine to perform a method of controlling musical tones to be generated, said method comprising:

a musical tone control step of controlling musical tones to be generated, according to a plurality of musical tone control parameters;

an envelope extracting step of extracting an envelope of an input signal;

an envelope processing step of processing the envelope extracted by said envelope extracting step;

a musical tone parameter altering step of altering at least one predetermined parameter of said musical tone control parameters according to the envelope processed by said envelope processing step; and a musical tone control parameter control step of delivering as part of said musical tone control parameters the envelope processed by said envelope processing step and the at least one predetermined parameter altered by said musical tone control parameter altering step to said musical tone control step.

12. A machine-readable storage medium containing instructions to cause a machine to perform a method of controlling musical tones to be generated, said method comprising:

a musical tone control step of controlling musical tones to be generated, according to a plurality of musical tone control parameters;

an envelope extracting step of extracting an envelope of an input signal;

an envelope processing step of processing the envelope extracted by said envelope extracting step;

a velocity detecting step of detecting a velocity of said input signal;

a musical tone control parameter altering step of altering at least one predetermined parameter of said musical tone control parameters according to the envelope processed by said envelope processing step and the velocity detected by said velocity detecting step; and a musical tone control parameter control step of delivering as part of said musical tone control parameters the envelope processed by said envelope processing step and the at least one predetermined parameter altered by said musical tone control parameter altering step to said musical tone control step.

* * * * *